US007192492B2

(12) United States Patent
Fortunati et al.

(10) Patent No.: US 7,192,492 B2
(45) Date of Patent: Mar. 20, 2007

(54) PROCESS FOR THE CONTROL OF INHIBITORS DISTRIBUTION IN THE PRODUCTION OF GRAIN ORIENTED ELECTRICAL STEEL STRIPS

(75) Inventors: Stefano Fortunati, Ardea (IT); Stefano Cicale', Rome (IT); Claudia Rocchi, Rome (IT); Giuseppe Abbruzzese, Montecastrilli (IT)

(73) Assignee: Thyssenkrupp Acciai Speciali Terni S.p.A., Terni (IT)

( * ) Notice: Subject to any disclaimer, the term of this patent is extended or adjusted under 35 U.S.C. 154(b) by 243 days.

(21) Appl. No.: 10/344,300

(22) PCT Filed: Aug. 8, 2001

(86) PCT No.: PCT/EP01/09168

§ 371 (c)(1),
(2), (4) Date: Jul. 28, 2003

(87) PCT Pub. No.: WO02/12572

PCT Pub. Date: Feb. 14, 2002

(65) Prior Publication Data

US 2005/0098235 A1 May 12, 2005

(30) Foreign Application Priority Data

Aug. 9, 2000 (IT) ..... RM2000A0451

(51) Int. Cl.
*H01F 1/16* (2006.01)
*H01F 1/18* (2006.01)

(52) U.S. Cl. ..... 148/111; 148/113; 148/121; 148/308

(58) Field of Classification Search ..... None
See application file for complete search history.

(56) References Cited

U.S. PATENT DOCUMENTS

| | | | | |
|---|---|---|---|---|
| 4,204,891 A | | 5/1980 | Shiozaki et al. | |
| 4,330,348 A | * | 5/1982 | Nagano | 148/111 |
| 5,597,424 A | | 1/1997 | Yoshitomi et al. | |
| 5,800,633 A | | 9/1998 | Inokuti | |

FOREIGN PATENT DOCUMENTS

| | | | |
|---|---|---|---|
| EP | 0 566 986 A1 | | 4/1993 |
| WO | WO 98/08987 | | 3/1998 |
| WO | WO 98/41660 | | 9/1998 |
| WO | WO 99/46413 | * | 9/1999 |

* cited by examiner

*Primary Examiner*—John P. Sheehan
(74) *Attorney, Agent, or Firm*—Abelman, Frayne & Schwab

(57) ABSTRACT

In the production of electrical steel strips, a special islab-reheating treatment before hot rolling is carried out so that the maximum temperature within the furnace is reached by the slab well before its extraction from the furnace. During the heating stage and performance at the highest temperatures of the thermal cycle, second phase particles are dissolved and segregated elements are distributed in the metallic matrix, while during cooling and temperature equalising steps of the slab in the furnace a controlled amount of small second phases particles are more homogeneously re-precipitated from the metallic matrix. Differently from all the conventional processes for the production of electrical steels, the slab reheating furnace become a site in which it is performed the precipitation of a controlled amount of second phases particles for the necessary grain growth control during the successive process steps.

13 Claims, 2 Drawing Sheets

PROCESS FOR THE CONTROL OF INHIBITORS DISTRIBUTION IN THE PRODUCTION OF GRAIN ORIENTED ELECTRICAL STEEL STRIPS

FIELD OF THE INVENTION

The present invention concerns a process for the regulation of grain growth inhibitors distribution in the production of grain oriented electrical steel strips and, more precisely, concerns a process in which an optimised distribution of said inhibitors is obtained starting from the high temperature heating of the slabs for hot-rolling, avoiding any unevenness due to temperature differences in the slab at the exit from the furnace and highly favouring the subsequent transformation process down to a strip of desired thickness, in which the secondary recrystallization occurs.

STATE OF THE ART

Grain oriented electrical steels are typically produced at industrial level as strips having a thickness comprised between 0.18 and 0.50 mm characterised by magnetic properties depending on the product class, the best product having magnetic permeability values higher than 1.9 T and core losses lower than 1 W/kg. The high quality of the grain oriented silicon steel strips (essentially a Fe—Si alloy) depends on the ability to obtain a very sharp crystallographic texture, which in theory should correspond to the so called Goss texture, in which all the grains have its own {110} crystallographic plane parallel to the strip surface and its own <001> crystallographic axis parallel to the strip rolling direction. This dependance is mainly due to the fact that the <001> axis is the direction of easiest magnetic flux transmission in the body-centered cubic crystals of the Fe—Si alloy; however, in the actual product there always exist some disorientation between 001 axes of adjacent grains, the higher said misorientation the lower the magnetic permeability of the product and the higher the power loss in the electrical machines utilising said product.

In order to obtain an orientation of the steel grains as close as possible to the Goss texture requires a rather complex process, essentially based on the control of a metallurgical phenomenon called "secondary recrystallization". During the occurence of said phenomenon, which takes place during the final part of the production process, after the annealing for primary recrystallization and before the final box-annealing, the few grains having an orientation close to the Goss one grow at the expenses of the other grains of the primary recrystallised product. To make this phenomenon occurr, non metallic impurities (second phases) are utilised, precipitated as fine and evenly distributed particles at the boundaries of the primary recrystallised grains. Such particles, called grain growth inhibitors, or in short inhibitors, are utilised to slow down the grain boundaries movement, to permit to the grains having an orientation close to the Goss one to acquire such a dimensional advantage that, once the second phases solubilization temperature is reached, they will rapidly grow at the expenses of the other grains.

The most utilised inhibitors are sulphides or selenides (of manganese and/or of copper, for instance) and nitrides in particular of aluminium or of aluminium and other metals, generically called aluminium nitrides; such nitrides allow to obtain the best quality.

The classic mechanism of grain growth inhibition utilises the precipitates formed during the steel solidification, essentially in continuous casting. Such precipitates, however, due to the relatively slow cooling temperature of the steel, are generated as coarse particles unevenly distributed into the metal matrix, and therefore are not able to efficiently inhibit the grain growth. They must, hence, be dissolved during the thermal treatment of the slabs before the hot-rolling, and then reprecipitated in the due form in one or more subsequent process steps. The uniformity of such heating treatment is an essential factor to obtain good results from the subsequent transformation process of the product.

The above is true both for such electrical steel strip production processes in which the precipitates actually able to regulate the secondary recrystallization the grain recrystallization are all present since the hot-rolled strip (for instance described in patents U.S. Pat. Nos. 1,956,559, US 4,225,366, EP 8,385. EP 17,830, EP 202,339, EP 219,181, EP 314,876), and for the processes in which such precipitates are formed, at least in part, after cold rolling or just before the secondary recrystallization (for instance, described in patents U.S. Pat. Nos. 4,225,366, US 4,473,416, 30 US 5,186,762, US 5,266,129, EP 339,474, EP 477,384, EP 391,335).

In the PCT Applications EP/97/04088, EP97/04005, EP97/04007, EP97/04009, EP97/040089, processes are described in which a certain level of inhibition is obtained in the hot-rolled product which, though not sufficient to control the secondary recrystallization, is important in controlling the grain boundaries mobility during the entire first part of the process (hot-rolled strip annealing, decarburization annealing). This definitely reduces the importance of a strict control of the annealing time/temperature parametres of the industrial processes (see PCT/EP/97/04009).

However, processes and plants up to now utilised for the slab heating, during which the coarse precipitates are redissolved (fully or in part, according to the production process), can not ensure a high temperature homogeneity within the slabs. This lack of homogeneity is greatly enhanced in the newest production processes in which the slab heating temperature is relatively low.

In fact, since the dissolution of precipitates is controlled by thermodynamic and kinetic laws exponentially depending on the temperature, it is clear that even temperature differences in the range of 50–1000° C. can result in widely different characteristics.

Moreover, the distribution of the elements necessary to the formation of inhibitors is rather non-homogeneous, also due to other factors (such as the phase transition, at the working temperatures, of some matrix zones from ferrite to austenite structure), thus causingan amplification of the undesirable effects of the low distribution uniformity and of the non-optimal dimensions of the precipitated inhibitors. Moreover other strictly technical factors contribute to render further complex the aspect of the uniformity of temperature in the slab coming out from the healing furnaces. In fact, during the heating process to the desired temperature, thermal gradients are created within the slabs, due to purely practical factors: the support zones of the slabs in the furnaces, both of the pushing and walking beam type, are strongly cooled, thus causing further temperature gradients in the slabs.

Such temperature gradients, particularly the ones due to the walking beams, do also cause mechanical resistance differences between different zones of the slabs, and related thickness variations in the rolled strips up to about a tenth of millimeter, which in turn cause microstructural variations into the final strips, to an extent up to 15% of the strip length.

Such problems are common to all the known electrical silicon steel strip production technologies and induce, particularly fo the high quality products, yield losses even of high level.

The problem remains still unsolved of the formation, during the heat treatment of the slabs before hot-rolling, of the desired quantity of precipitates useful for the inhibition of the grain growth (i.e. of the inhibitors) and the one of the even distribution of such precipitates throughout the whole steel mass, the lack of such conditions rendering more difficult to obtain a final product of high and constant quality.

DESCRIPTION OF THE INVENTION

The present invention aims to eliminate such drawbacks, proposing a treatment permitting to obtain a final product having excellent properties homogeneity, particularly in the case of production technologies for grain oriented electrical steel strips, utilising the strategy of: (i) reducing the slab heating temperatures with respect to conventional technologies, to fully or partially avoid the dissolution of coarse precipitates (second phases) obtained during casting, and (ii) creating after the hot-rolling step the necessary amount of inhibitors able to control the oriented secondary recrystallization.

According to present invention, in a process for the production of grain oriented electrical steel strips, in which a silicon steel is continuously cast, hot-rolled, cold-rolled to obtain a cold-rolled strip which is then subjected to a continuous annealing for primary recrystallization and if necessary for decarburization, and subsequently to a secondary recrystallization annealing at a higher temperature than said primary recrystallization one, the following operative steps are performed in sequence:

- slab heating in a plurality of steps, the treating temperature during the last step, of unloading the furnace, being lower than at least one of the preceding treating temperatures;
- cold-rolling in one or more reduction steps, separated by intermediate annealings, in which in at least one of said steps a reduction higher than 75% is carried out;
- continuous primary recrystallization annealing of the cold-rolled strip, at a temperature comprised between 800 and 950° C.

In the slab heating, the temperature of the last treatment zones as well as the residence time of the slab into each of said zones are regulated so that a heat transfer is obtained between slab core and slab surface, such that the respective temperatures (of surface and core) equalise before the exit from the last treatment zone at a temperature lower than the maximum temperature reached in the furnace by the slab surface. This allows to carry out the dissolution and diffusion processes of the elements necessary to form the inhibitors during the treatment at higher temperature, while during the last treatment, after uniformation of slab surface and core temperatures, the previous dissolved elements are reprecipitated in form and distribution adequate to the grain growth control.

It is preferable that the slabs pass through the penultimate heat treatment zone in a time interval comprised between 20 and 40 minutes, and through the last zone in a time interval comprised between 15 and 40 minutes. The maximum heating temperature reached is preferably comprised between 1200 and 1400° C., and the temperature of the last treatment zone is preferably comprised between 1100 and 1300° C.

Preferably, the maximum slab heating temperature should be lower than the one for the formation of liquid slag on the slab surface.

Moreover, according to the present invention, between the slab heating zone at the maximum temperature and the last zone at a lower temperature, it is possible to carry out a slab thickness reduction, preferably comprised between 15 and 40%. This thickness reduction permits to homogenize the slab metal matrix as well as to improve the cooling speed control, and thus the slab thermal homogeneity. It must be noted that the above thickness reduction does not correspond to the so called "prerolling", largely utilized in the hot-rolling of slabs heated to very high temperature; in fact, the pre-rolling is carried out before the slab reaches the maximum treatment temperature,while according to the present invention the thickness reduction is carried out during the slab cooling between the maximum treatment temperature and the lower one of extraction of the slab from the furnace.

If this thickness reduction technique is adopted, it is possible to work either discontinuously, utilising two different furnaces at different temperatures, or continuously utilising, for instance, a tunnel furnace having, before the last treatment zone at a lower temperature, an apparatus for intermediate rolling. This last solution is particularly apt to the treatment of slabs produced utilising thin-slab casting techniques.

The slabs, in which the precipitation of at least part of the grain growth inhibitors already occurred, are hot-rolled and the hot-rolled strips thus obtained are then annealed and cold-rolled to the final thickness; as already said, the cold rolling operation can be carried out in one or more steps, with intermediate annealing, at least one of the rolling steps being preferably carried out with a thickness reduction of at least 75%.

Still according to present invention, a decarburization treatment is carried out during the primary recrystallization annealing, with a heating time up to the primary recrystallization temperature comprised between 1 and 10 s.

In the case of the adoption of a slab heating temperature insufficient to the complete dissolution of the precipitates available, which will afterward form the grain growth inhibitors, such inhibitors will be preferably produced during one of the heat treatmens after cold-rolling and before the start of secondary recrystallization, by reaction between the strip and suitable liquid, solid or gaseous elements, specifically rising the nitrogen content of the strip. Preferably, the nitrogen content of the strip is rised during a continuous annealing of the strip having the final thickness by reaction with undissociated ammonia.

In this last case, it is advisable to strictly control the steel composition with reference to the initial content of the elements useful for the formation of nitrides, such as aluminium, titanium, vanadium, niobium and so on. In particular, the soluble aluminium content in the steel is comprised between 80 and 500 ppm, preferably between 250 and 350 ppm.

As far as nitrogen is concerned, it must be present in the slabs in relatively low concentrations, for example comprised between 50 and 100 ppm.

Once the cold-rolled strip is nitrided, to directly form nitride precipitates of type, amount and distribution apt to inhibit grain growth, the. strip itself undergoes high-temperature continuous annealing, during which annealing the secondary recrystallization is carried out, or at least started.

The equalizing effect of the slab temperature according to present invention is shown in the enclosed drawings, in which.

Figure 1:
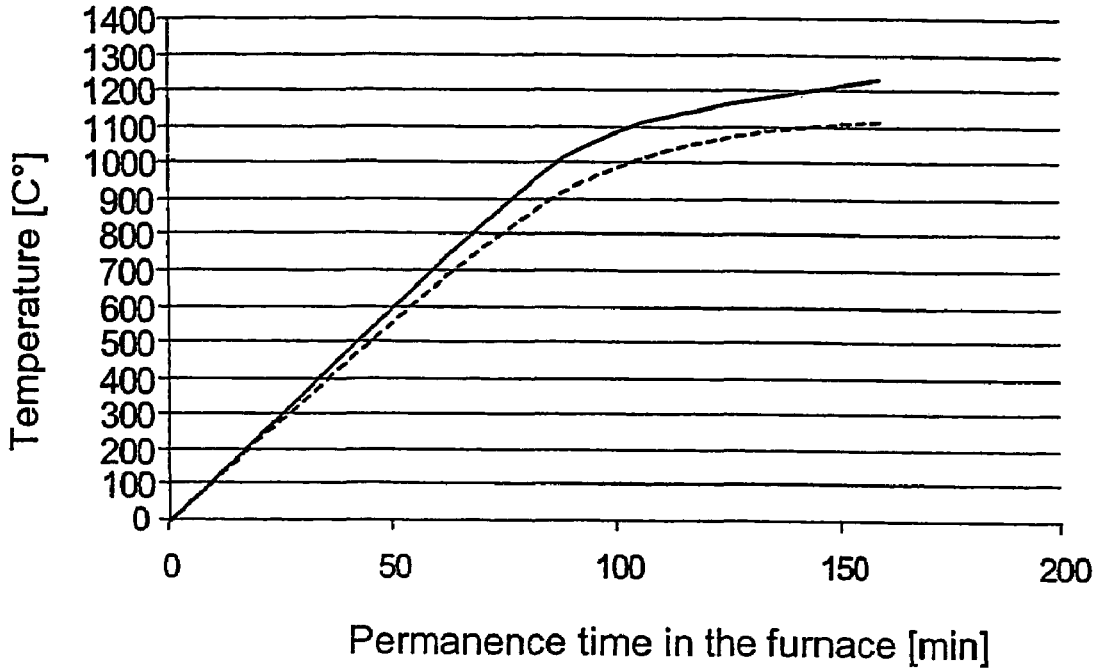
Fig. 1 PRIOR ART
FIG. 1 represents a conventional schematic slab-heating diagram, in which the extraction temperature from the furnace is the maximum one reached.

In the known technology, as can be seen in FIG. 1, the continuous temperature variation curve of the slab skin is, during the heating, always higher than the core temperature, shown by the dashed curve, such temperature difference still remaining in the last section of the furnace.

Figure 2:
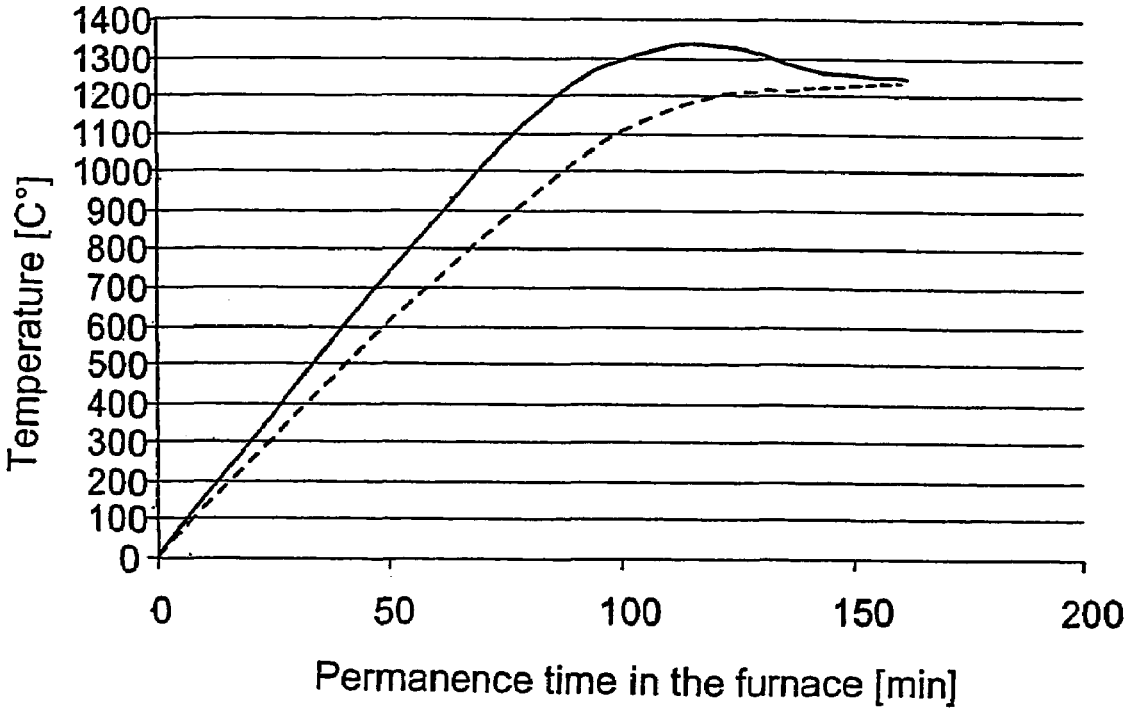
FIG. 2 represents a schematic slab-heating diagram according to present invention.

On the contrary, according to present invention (FIG. 2) the slab skin temperature, shown with a continuous line, after reaching a maximum decreases thus approximating the core temperature, shown with a dashed line, and practically coinciding with it in the last section of the furnace.

It is thus possible to obtain a very uniform distribution of the inhibitors-forming elements and, consequently, an excellent distribution of the same inhibitors during the subsequent cooling. Said temperature uniformation concerns, at least partially, also the temperature differences in the slab skin due to the cooled support zones of the furnace; in FIG. 3 and 4 it can be seen that according to the present invention it is possible to reduce the thickness variations in the hot-rolled strip due to cold spots caused by said cooled slab-supporting zones.

The present invention will now be described in the following Examples, not intended to limit its scope and meaning.

EXAMPLE 1

A silicon steel melt from scrap, produced in an electric furnace and comprising at the casting station (weight %) Si 3.15%, C 0.035%, Mn 0.16%, S 0.006%, $Al_{sol}$ 0.030%, N 0.0080%, Cu 0.25% and impurities usual in steelmaking, was continuously cast in 18 t slabs. Eight slabs were selected and submitted, in couples, to experimental industrial hot-rolling programs characterised by different slab-heating cycles in a walking beam furnace. The four experimental cycles were carried out deciding the temperature set of the last two zones of the furnace as shown in Table 1. The transit speed of the slabs through the furnace was selected to guarantee a permanence into the penultimate (pre-equalizing) furnace zone of 35 minutes and into the last (equalizing) zone of 22 minutes.

TABLE 1

| | Pre-equalizing zone T° C. | Equalizing zone T° C. | |
|---|---|---|---|
| CONDITION A | 1200 | 1230 | COMPARISON |
| CONDITION B | 1150 | 1180 | COMPARISON |
| CONDITION C | 1330 | 1230 | INVENTION |
| CONDITION D | 1330 | 1180 | INVENTION |

The as heated slabs were sent via a roller table to a roughing mill in which, in 5 passages, a global thickness reduction of 79% was obtained, and the thus obtained bars were hot-rolled in 7 passages in a continuous finishing mill, down to the final thickness of 2.10 mm.

The so obtained hot-rolled strips were then single-stage (6 passes) cold-rolled at a mean thickness of 0.285 mm. Each cold-rolled strip was divided into two coils weigthing about 8 tons each. Four coils, one for each condition (Table 1), were then conditioned and treated in an experimental continuous decarburization and nitriding line. Each strip was treated with 3 different decarburization and primary recrystallization temperatures; in each case, at the end of this decarburization step the strips were continuously nitrided in a wet Hydrogen-Nitrogen mixture containing ammonia, at a temperature of 930° C., to rise the nitrogen content of the strip by 90–120 ppm. Samples of each strip were coated with MgO and then subjected to a simulation of the final box-annealing usual with those products, with a heating velocity up to 1200° C. of 20° C./h, soaking at 1200° C. for 20 h in dry hydrogen and then cooled in controlled conditions. In Table 2 the obtained magnetic induction values (in Tesla) at 800 A/m are reported.

TABLE 2

| | Decarb. Temp. 830° C. | Decarb. Temp. 850° C. | Decarb. Temp. 870° C. |
|---|---|---|---|
| CONDITION A | 1.83 T | 1.89 T | 1.87 T |
| CONDITION B | 1.89 T | 1.89 T | 1.75 T |
| CONDITION C | 1.88 T | 1.93 T | 1.94 T |
| CONDITION D | 1.92 T | 1.94 T | 1.89 T |

EXAMPLE 2

The four coils remaining of the four different slab heating conditions of Example 1, were treated in an industrial continuous decarburization line at a temperature of 850° C. and continuously nitrided at 930° C., in the same conditions of the experimental line (Example 1) and then transformed down to end-product with industrial box annealing according to the same thermal cycle described in Example 1. The strips were then continuously thermal-flattened and coated with tensioning insulating coating, and then qualified. The mean values of the magnetic characteristics of the four strips are shown in Table 3.

TABLE 3

| | B800 (TESLA) | P17 (W/kg) |
|---|---|---|
| CONDITION A | 1.90 | 1.04 |
| CONDITION B | 1.88 | 1.05 |
| CONDITION C | 1.94 | 0.95 |
| CONDITION D | 1.93 | 0.93 |

In which B800 is the magnetic induction value measured at 800 A/m, and P17 is the core losses value measured at 1.7 T.

EXAMPLE 3

A silicon steel melt was produced comprising (in weight %) Si 3.10%, C 0.028%, Mn 0.150%, S 0.010%, Al 0.0350%, N 0.007%, Cu 0.250%. This melt was solidified in 18 t slabs 240 mm thick, utilising an industrial continuous casting machine.

Said slabs were then hot-rolled after a heating treatment in a walking beam furnace during about 200 min and reaching a maximum temperature of 1340° C. followed by a transit in the last zone of the furnace, before hot-rolling, at a temperature of 1220° C. for 40 min.

Six of such slabs were then roughened at a thickness of 50 mm and sequence-rolled in a rolling mill to final thicknesses comprised between 3.0 and 1.8 mm. The strips thus produced were subjected to a continuous annealing at a maximum temperature of 1100° C. and cold-rolled to a final thickness of 0.23 mm. In Table 4 the different thicknesses obtained as well as relevant reduction ratio are shown. All the strips were transformed into the end-product utilising the same industrial production cycle (specifically, a decarburization temperature of 865° C. was adopted), continuous annealing nitrided for a nitrogen addition of between 100 and 130 ppm, and then box annealed, utilizing a heating speed up to 1200° C. of 40° C./h. The magnetic characteristics obtained, also shown in Table 4, demonstrate a link between cold-reduction ratio and magnetic characteristics of end product. With the utilised conditions, best results are obtained with cold-rolling reduction comprised between 89% and 91.5%. Must be observed, however, that in the whole cold-reduction field explored, with single stage cold-rolling procedure, products are obtained having magnetic characteristics adequate for the different commercial classes of grain oriented electrical strips.

TABLE 4

| Hot-rolled strip thickness (mm) | Cold-rolled strip thickness (mm) | Deformation % | B800 (T) | P17 (W/kg) |
|---|---|---|---|---|
| 3 | 0.23 | 92.7 | 1.88 | 1.03 |
| 2.7 | 0.23 | 91.5 | 1.93 | 0.89 |
| 2.5 | 0.23 | 90.8 | 1.91 | 0.95 |
| 2.1 | 0.23 | 90.0 | 1.90 | 0.97 |
| 2.1 | 0.23 | 89.0 | 1.89 | 1.00 |
| 1.8 | 0.23 | 87.2 | 1.87 | 1.05 |

EXAMPLE 4

A steel melt containing (weight %) Si 3.180%, C 0.025%, Mn 0.150%, S 0.012%, Cu 0.150%, Al 0.0280%, N 0.008%, was cast in 18 t slabs 240 mm thick, in an industrial continuous casting plant.

Some of said slabs were then heated in a walking beam furnace for about 200 min at a maximum temperature of 1320° C., with a transit of the slabs in the furnace last zone at a temperature of 1150° C. for about 40 min, and then hot-rolled. The slabs were roughened at a thickness of 40 mm and then sequence hot-rolled in a rolling mill to strips having a constant thickness of 2.8 mm. Said strips were then continuous-annealed at a maximum temperature of 1000° C., cold-rolled at intermediate thicknesses comprised between 2.3 and 0.76 mm; all the strips were then continuous-annealed at 900° C. and again cold-rolled at the final thickness of 0.29 mm. Table 5 shows the thicknesses obtained and relevant cold-reduction ratios.

All the strips were then continuoulsy annealed for decarburization and nitriding, coated with an MgO-based annealing separator and box-annealed up to a maximum temperature of 1210° C. to form onto the strip surface a forsterite layer, develop the secondary recrystallization and eliminate S and N from the steel. The final magnetic characteristics reported in Table 5 confirm the dependance on the cold-reduction ratio shown in Example 3, and evidenciate the opportunity to adopt is a final cold-reduction ratio higher than 75%, in order to industrially obtain the commercially required magnetic characteristics.

TABLE 5

| Strip thickness (mm) | | First cold-rolling | Final | Final cold-rolling | | |
|---|---|---|---|---|---|---|
| Hot-rolled | First cold-rolled | reduction (%) | thickness (mm) | reduction (%) | B800 (T) | P17 (W/kg) |
| 2.8 | 2.30 | 17.9 | 0.29 | 87.4 | 1.91 | 0.96 |
| 2.8 | 2.00 | 28.6 | 0.29 | 85.5 | 1.89 | 1.02 |
| 2.8 | 1.70 | 39.3 | 0.29 | 82.9 | 1.88 | 1.08 |
| 2.8 | 1.40 | 50.0 | 0.29 | 79.3 | 1.86 | 1.15 |
| 2.8 | 1.15 | 58.9 | 0.29 | 74.8 | 1.83 | 1.30 |
| 2.8 | 0.90 | 67.9 | 0.29 | 67.8 | 1.79 | 1.42 |
| 2.8 | 0.76 | 72.9 | 0.29 | 61.8 | 1.73 | 1.61 |

EXAMPLE 5

A steel composition comprising (weight %) Si 3.30%, C 0.050%, Mn 0.160%, S 0.010%, $Al_{sol}$ 0.029%, N 0.0075%, Sn 0.070%, Cu 0.300%, Cr 0.080%, Mo 0.020%, P 0.010%, Ni 0.080%, B 0.0020%, was continuously cast in thin slabs 60 mm thick. Six of said slabs were then hot-rolled according to the following cycle: heating at 1210° C., subsequent equalization at 1100° C. and direct hot-rolling to 2.3 mm thick strips (cycle A). Six other slabs were hot-rolled to the same thickness, but directly heating at 1100° C., without pre-heating at higher temperature (cycle B).

All the hot-rolled strips were then transformed to final product using the same cycle: pickling, single-stage cold rolling at 0.29 mm, continuous annealing for decarburization and nitriding, coating with MgO-based annealing separator, final box annealing, thermal flattening and coating with insulating coating. Final results, expressed as mean values of the magnetic properties along each strip are shown in Table 6.

TABLE 6

| STRIP No. | Heating cycle | B800 (T) | P17 (W/kg) | |
|---|---|---|---|---|
| 1 | A | 1.92 | 0.97 | Invention |
| 2 | A | 1.93 | 0.95 | Invention |
| 3 | A | 1.93 | 0.96 | Invention |
| 4 | A | 1.92 | 0.97 | Invention |
| 5 | A | 1.92 | 0.97 | Invention |
| 6 | A | 1.93 | 0.96 | Invention |
| 7 | B | 1.87 | 1.20 | Comparison |
| 8 | B | 1.92 | 0.98 | Comparison |
| 9 | B | 1.88 | 1.15 | Comparison |
| 10 | B | 1.87 | 1.15 | Comparison |
| 11 | B | 1.90 | 1.03 | Comparison |
| 12 | B | 1.89 | 1.05 | Comparison |

Figure 3:
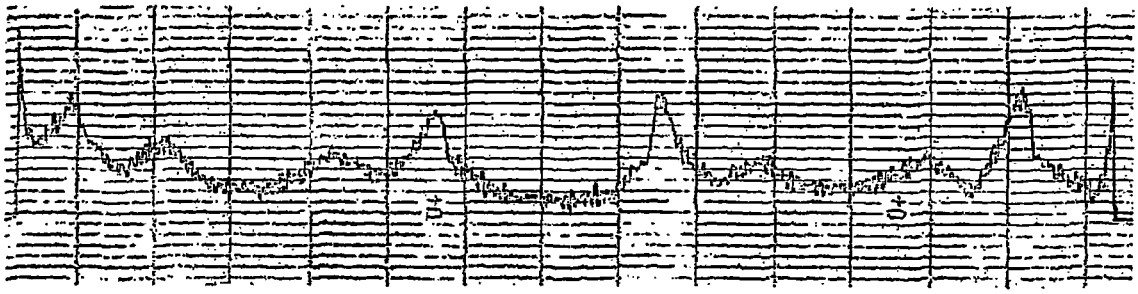
Fig. 3 PRIOR ART
FIG. 3 represents a diagram of the variations along the strip length (abscissa) of the strip thickness (ordinate) after hot-rolling, utilizing a conventional slab heating (each division of the ordinates corresponds to 0.01 mm)
Figure 4:
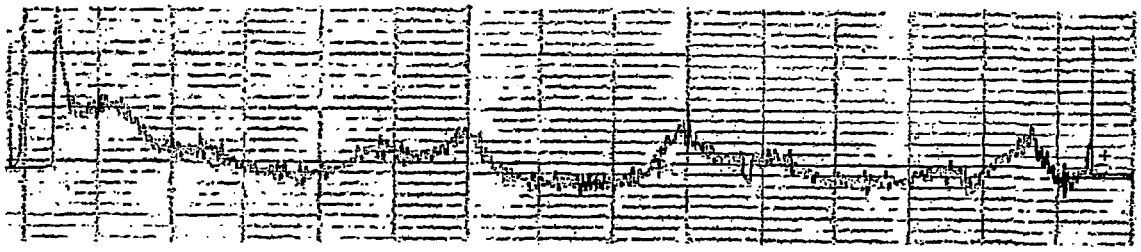
FIG. 4 represents a diagram of the variations along the strip length (abscissa) of the strip thickness (ordinate) after hot-rolling, utilizing a slab heating according to the invention (each division of the ordinates corresponds to 0.01 mm).

It can be seen that utilising a slab heating cycle according to present invention better results can be obtained, particularly with reference to their uniformity. In FIGS. 3 and 4 thickness variations of hot-rolled strips are shown measured at the exit of the hot-rolling mill, respectively on strips 7 and 1.

EXAMPLE 6

A steel containing (weight %) Si 3.30%, C 0.015%, Mn 0.100%, S 0.010%, Cu 0.200%, Al 0.032%, N 0.007%, was continuously cast in slabs 240 mm thick in an industrial casting machine.

Some slabs were then rolled after the following thermo-mechanical cycle (cycle A):

Heating in a pushing furnace at a maximum temperature of 1360° C.;

Hot thickness reduction from 240 mm to 160 mm in a roughing mill;

Heating in a walking-beam furnace at a maximum temperature of 1220° C.

The other slabs were rolled, for comparison, after heating in a walking-beam furnace at a maximum temperature of 1220° C., without pre-heating and roughening (cycle B).

The thickness of the hot-rolled strips was comprised between 2.1 and 2.3 mm.

The hot -rolled strips were all continuously annealed at a maximum temperature of 1000° C., then single-stage cold-rolled at a mean thickness of 0.29 mm, ensuring that the strips, after the second rolling pass, reached a temperature of 210° C. The cold-rolled strips were then continuous annealed for decarburization and nitriding, to obtain a carbon content comprised between 10 and 30 ppm and a nitrogen content comprised between 100 and 130 ppm.

After coating with MgO, the strips were box annealed for secondary recrystallization and formation of a forsterite surface layer. The obtained magnetic characteristics are shown in Table 7.

TABLE 7

| Strip No. | Heating cycle | B800 (T) | P17 (W/kg) | |
|---|---|---|---|---|
| 1 | A | 1.94 | 0.93 | Invention |
| 2 | A | 1.93 | 0.92 | Invention |
| 3 | A | 1.94 | 0.92 | Invention |
| 4 | A | 1.94 | 0.93 | Invention |
| 5 | B | 1.88 | 1.03 | Comparison |
| 6 | B | 1.88 | 1.04 | Comparison |
| 7 | B | 1.87 | 1.10 | Comparison |
| 8 | B | 1.89 | 1.02 | Comparison |

In all the tests made in each of the above Examples, it was observed that working according to present invention better magnetic permeability and core losses values are consistently obtained than those obtained operating according to already known slab heating methods, in which the slab temperature at the exit from the furnace corresponds to the maximum temperature reached by the slabs. Moreover, working according to present invention, the magnetic characteristics variations along the strips are much more limited (by about 50–60%) than those obtainable with traditional slab heating methods.

Accordingly, the maximum variation of permeability and core losses measured every 1 m along the steel strip according to present invention is within 2% and 6%, respectively.

The invention claimed is:

1. Process for the control of inhibitors in the production of grain oriented electrical steel strips, in which a silicon steel is continuously cast, hot-rolled, cold-rolled to obtain a cold-rolled strip which is then subjected to a continuous annealing for primary recrystallization and if necessary for decarburization, and subsequently to a secondary recrystallization annealing at a higher temperature than said primary recrystallization, said process comprising the following steps:

slab heating in a furnace in a plurality of steps at different temperatures before hot rolling, the treating temperature during the last step, prior to exiting the furnace being lower than the maximum temperature reached in the furnace in at least one of the previous heating steps;

cold-rolling in one or more reduction steps, separated by intermediate annealing, in which in at least one of said steps a reduction greater than 75% is carried out; and continuous primary recrystallization annealing of the cold-rolled strip, at a temperature comprised between 800 and 950° C.

2. Process according to claim 1, in which in said slab heating treatment a hot-rolling step is carried out between a high temperature heating step and said final heating step at lower temperature.

3. Process according to claim 1, in which said slab heating treatment is carried out in two steps, the temperature of the first step being comprised between 1200 and 1400° C. and the temperature of the second step being comprised between 1100 and 1300° C.

4. Process according to claim 3, in which the heating temperature in the first heating step does not exceed the temperature at which liquid slag forms on the slab surface.

5. Process according to claim 1, wherein during the primary recrystallization a decarburization treatment is carried out.

6. Process according to claim 1 wherein in one of the thermal treatments after the cold rolling and before the start of secondary recrystallization, an enhancement of the inhibitors content in the strip is carried out, by reacting the strip with appropriate elements in solid, liquid or gaseous form.

7. Process according to claim 1, wherein the soluble aluminum content in the steel is comprised between 80 and 500 ppm.

8. Process according to claim 7, wherein aluminum content in the steel is comprised between 250 and 350 ppm.

9. Process according to claim 6, wherein the enhancement of inhibitors content is carried out within the continuous annealing treatment of the strip having its final thickness, by reaction with undissociated ammonia.

10. Process according to claim 9, wherein after said enhancement of inhibitors content the strip undergoes a further continuous annealing treatment to carry out, or at least to start, the oriented secondary recrystallization.

11. Process according to claim 1, wherein an annealing of the hot-rolled strip precedes the cold rolling.

12. Process according to claim 1, wherein the heating time for the cold-rolled strip to reach the primary recrystallization temperature is comprised between 1 and 10 seconds.

13. Electrical steel strip having high magnetic characteristics obtained according to the process of claim 1, wherein the maximum variation of permeability and core losses, measured along the steel strip at a plurality of points, is within 2% and 6%, respectively.

* * * * *